US007273212B1

(12) United States Patent
Kolbaba

(10) Patent No.: US 7,273,212 B1
(45) Date of Patent: Sep. 25, 2007

(54) ARTICLE SUPPORT APPARATUS, SYSTEM, AND METHOD

(76) Inventor: Scott L. Kolbaba, 1176 Duncan Ave., Elgin, IL (US) 60120

( * ) Notice: Subject to any disclaimer, the term of this patent is extended or adjusted under 35 U.S.C. 154(b) by 0 days.

(21) Appl. No.: 11/404,198

(22) Filed: Apr. 14, 2006

(51) Int. Cl.
*A63F 1/06* (2006.01)
*A47B 11/00* (2006.01)

(52) U.S. Cl. ..... 273/280; 273/309; 108/103; 108/140

(58) Field of Classification Search ..... 273/280, 273/284, 309; 108/102, 103, 104, 137, 139, 108/140, 143
See application file for complete search history.

(56) References Cited

U.S. PATENT DOCUMENTS

| | | | | | |
|---|---|---|---|---|---|
| 2,008,078 | A | * | 7/1935 | Martin | 108/26 |
| 2,610,099 | A | * | 9/1952 | McNamara Jr. | 108/140 |
| 2,857,224 | A | * | 10/1958 | Del | 108/140 |
| 3,195,114 | A | | 7/1965 | Gunderson et al. | |
| 3,224,391 | A | * | 12/1965 | Joseph | 108/140 |
| D224,874 | S | | 10/1972 | Cook | |
| D237,563 | S | | 11/1975 | Gerber | |
| 4,146,228 | A | * | 3/1979 | Laciste | 273/126 R |
| D257,925 | S | | 1/1981 | Redmond | |
| D258,029 | S | | 1/1981 | Redmond | |
| D265,661 | S | | 8/1982 | Schoenfeld et al. | |
| 4,378,943 | A | * | 4/1983 | Newberry | 273/280 |
| 4,591,161 | A | * | 5/1986 | Vanderhoof | 273/272 |
| D292,545 | S | * | 11/1987 | Peacock | D6/486 |
| 4,850,595 | A | * | 7/1989 | Sherman et al. | 273/240 |
| 5,026,052 | A | | 6/1991 | Shelnutt | |
| 5,193,465 | A | | 3/1993 | Delaye et al. | |
| 5,318,299 | A | * | 6/1994 | Beaster et al. | 273/148 R |
| 5,549,052 | A | * | 8/1996 | Hoffman | 108/139 |
| D400,743 | S | | 11/1998 | Jenkins et al. | |
| 5,988,636 | A | | 11/1999 | Kilmer | |
| D468,776 | S | | 1/2003 | Oliver et al. | |
| 6,634,646 | B2 | | 10/2003 | Wolpert et al. | |
| D483,202 | S | | 12/2003 | Slemmons | |
| D486,190 | S | | 2/2004 | WInter et al. | |
| D491,233 | S | | 6/2004 | Winter et al. | |
| 6,766,747 | B1 | | 7/2004 | Wolfe | |
| 6,802,264 | B2 | * | 10/2004 | Kasak et al. | 108/50.01 |
| 6,976,434 | B2 | | 12/2005 | Roig et al. | |
| 7,063,320 | B1 | * | 6/2006 | Sheeks et al. | 273/126 R |

* cited by examiner

*Primary Examiner*—William M. Pierce
(74) *Attorney, Agent, or Firm*—Meroni & Meroni, P.C.; Charles F. Meroni, Jr.; Christopher J. Scott

(57) ABSTRACT

An article support apparatus facilitates article interaction such as game play upon an oblong game table. The article or game support apparatus comprises a support plate, an anchor plate, and an article-positioning assembly extending therebetween. The article-positioning assembly may comprise a plate-extending assembly and a plate-rotating assembly. The plate-extending assembly functions to extend the game support plate away from the anchor plate. The anchor plate is of sufficient mass to interface the game support apparatus with a support surface and prevent the extended game support apparatus from tipping. The support plate functions to support an interactive article such as a gaming device or a common board game. The selected gaming device is supportable atop the game support plate and is thus extendable to separated player stations about the game support surface. The article or game support apparatus functions to enable game play in a spaced player setting.

20 Claims, 5 Drawing Sheets

ARTICLE SUPPORT APPARATUS, SYSTEM, AND METHOD

BACKGROUND OF THE INVENTION

1. Field of the Invention

The present invention generally relates to an apparatus for supporting and positioning an article, such as a gaming device. More particularly, the present invention relates to an article support apparatus for facilitating article interaction such as game play in a spaced player setting, such as may be defined by board game play at an oblong table.

2. Description of the Prior Art

The game of checkers is ancient. It is thought that the earliest form of checkers was a game discovered in an archeological dig at Ur in Iraq. Carbon dating of the artifacts found at the archeological dig at Ur would support a finding that a version of this game was played around 3000 B.C. However, the game used a slightly different board, a different number of pieces and no one is quite certain of the exact rules. The continued popularity of the ancient game of checkers underscores the longevity of games as well as their usefulness in society. Game enthusiasts continue to develop novel ways and means to enhance the appeal and excitement of the gaming experience. Some of the more pertinent patented prior art relating to gaming tables and the like for enhancing the gaming experience are listed and briefly described hereinafter.

U.S. Pat. No. 3,185,114 ('114 patent), which issued to Consin, discloses a Retractable Table Top Shelf. The '114 patent teaches a slidingly mounted shelf which is slidingly bracketed to an underneath side of a restaurant or an equivalent table and which, when it is not in use, is retracted to assume a hidden or concealed position beneath and within the perimeter limits of the table top but is available and is so mounted at least one accessible end of the table that is may be withdrawn and caused to assume an outstanding position where it then provides an extra facility which is capable of being used in a number of ways. For instance, where the service involved is that which is afforded in a cafeteria it will be evident that the extending shelf may be employed to support one or more empty trays which are to be returned to the kitchen for washing.

U.S. Pat. No. 5,026,052, which issued to Shelnutt, discloses a Game and Cruciform Game Table. The '052 patent teaches a game table having a cruciform shape when seen in plan view. A generally circular "in play" area is bounded by four generally rectangular and contiguous base areas. The table top is flat and the "in play" area and the surrounding base areas are demarcated only by a generally circular line of demarcation. Four ball-receiving pockets are equidistantly and circumferentially spaced about the periphery of the circular "in play" area, and points are scored by holing balls in those pockets. No ball can be holed unless it is in the "in play" area. However, each player may take a positioning shot to knock a ball into the "in play" area prior to taking a scoring shot. There are two different sets of balls and in some games, all members of one set must be holed before any members of the second set. A cue ball and a bogey ball are also involved in play, and detailed rules govern the several games.

U.S. Pat. No. 5,193,465 ('465 patent), which issued to Delaye et al., discloses a Table Assembly with Circumferentially Disposed Retractable Extension Members. The '465 patent teaches a table assembly with circumferentially disposed retractable extension members. The extension members, when not in service, are vertically stored beneath the table plate in radially space relationship with each other. On purpose to facilitate such a storing, each extension member is articulated to the table plate by a hinge-slider assembly.

U.S. Pat. No. 5,988,636 ('636 patent), which issued to Kilmer, discloses a Multi-Game Table Top System. The '636 patent teaches a multi-game table top system for providing a table top which converts into a multi-game recreational area allowing multiple people to utilize said table top for recreational purposes such as golf, soccer, or hockey, and thereafter reverting to the table top's original purpose. The inventive device includes a reticulated table top, a golf transparent board, a soccer transparent board, and a hockey transparent board where said boards are removably securable to the upper surface of the reticulated table top by a plurality of securing magnets around the edges. The reticulated table top is constructed from steel coated with a permanently bonded plastisol coating approximately one-quarter of an inch.

U.S. Pat. No. 6,634,646 ('646 patent), which issued to Wolpert, et al., discloses a Portable Game Table. The '646 patent teaches a portable game table having a protective outer surface when in the closed position. The portable game table includes a game table having an outer surface and a case configured to attach to the game table. A portion of the outer surface of the game table includes a portion of the protective outer surface. The game table may be configured to have a game played thereon, such as football, billiards and air hockey.

U.S. Pat. No. 6,976,434 ('434 patent), which issued to Roig et al., discloses a Floating Amphibious Game Table. The '434 patent teaches a floating amphibious game table that may be used on both land and water. The game table has a base member that has an upper surface and a lower surface. A plurality of upper openings in the upper surface of the base member is adapted to receive beverage containers. A plurality of lower openings in the lower surface of the base member is adapted to receive a plurality of legs. The game table floats to allow for use on water. The game table receives the plurality of legs to allow for use on land.

U.S. Pat. No. 6,766,747 ('747 patent) which issued to Wolfe, discloses a Game Table with Recessed Game Board Storage Area. The '747 patent teaches a game table which includes a storage area with a center leaf horizontally mounted in the storage area. When the top cover is in a closed position, the center leaf is positioned at the bottom of the storage area. A pulley system is used to raise the center leaf into a playing position when the top cover is moved to the open position. When the top cover is closed again, the pulley system lowers the center leaf into the storage area. A game board and game pieces positioned on the center leaf are maintained in the same position when the top cover is closed and the center leaf is lowered into the storage area. By maintaining the center leaf in a horizontal position, persons playing a game can suspend the game and safely keep the game pieces in the same position by merely closing the top cover. The game may be resumed by opening the top cover to raise the center leaf back into the playing position.

It will be seen from an inspection of the foregoing as well as from a general consideration of the state of the art that the prior art does not teach a game support apparatus for enabling game play in a spaced player setting whereby the game support apparatus essentially comprises a game support plate, certain plate-extending means, and certain plate-anchoring means. Thus, the prior art perceives a need for a game support apparatus for enabling game play in a spaced player setting whereby the game support apparatus essentially comprises a game support plate, certain plate-extending means, and certain plate-anchoring means.

SUMMARY OF THE INVENTION

It is an object of the present invention to provide a game support apparatus for enabling game play in a spaced player setting whereby the game support apparatus essentially comprises a game support plate, certain plate-extending means, and certain plate-anchoring means. The plate-extending means function to extend the game support plate away from the anchoring means, which anchoring means function to interface the game support apparatus with a gaming support surface such as a common kitchen or recreational table. Inherently, the gaming support surface has physically separated player stations.

The game support plate functions to support a gaming device such as a common board game. The selected gaming device is supportable atop the game support plate and has a play-enabling portion such as playing surface. The game support plate is thus selectively extendable to the separated player stations and the play-enabling portion of the gaming device enables game play. Thus, the game support apparatus functions to enable game play in a spaced player setting.

Certain gaming methodology is further contemplated by the present invention and in this regard, the method may be summarized as comprising the steps of centralizing a game-positioning assembly relative to separated player stations; extending the game-positioning assembly to a select (initial) player station for enabling assembly-extended game play; and retracting the game-positioning assembly from the select player station for enabling assembly-retracted game pause.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings.

DETAILED DESCRIPTION OF THE PREFERRED EMBODIMENT(S)

Figure 1:
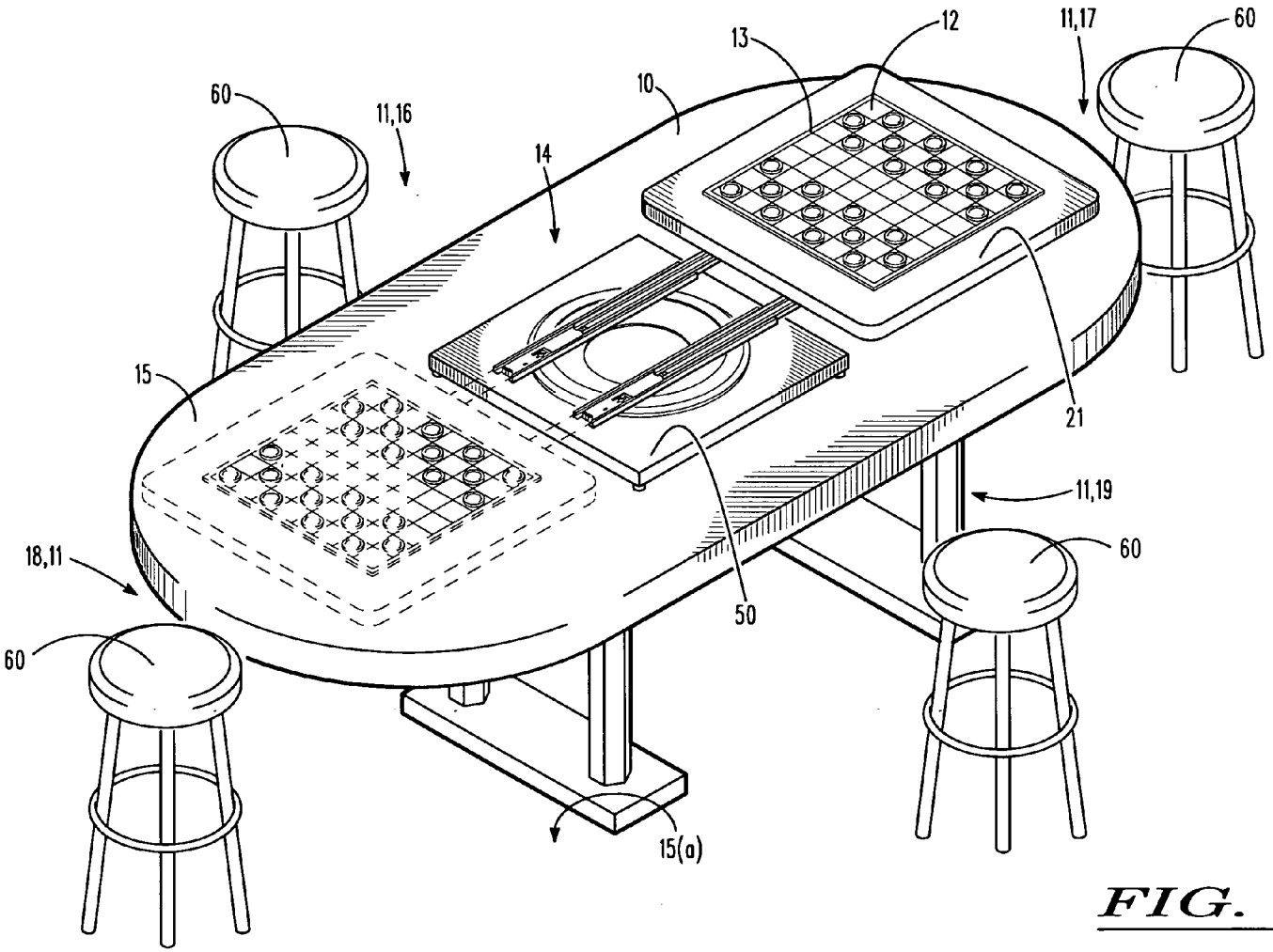
FIG. 1 is a perspective view of a gaming system of the present invention showing an oblong game support structure, a plurality of separated or spaced player stations, a game support apparatus in a first extended state shown in solid, the game support apparatus in a second extended state shown in phantom, and a common board game supported by the game support apparatus.

Referring now to the drawings in more specificity, the preferred embodiment of the present invention concerns an article support apparatus or game support apparatus 20 for enabling or facilitating article interaction such as game play in a spaced player setting as generally depicted in FIG. 1. It will be understood from an inspection of FIG. 1 that board games and the like are typically played upon a support surface 15 at a gaming table or similar other gaming support structure 10 with a plurality of player stations 11 spaced about the periphery of the gaming table or gaming support structure 10.

The support surface 15 of the gaming table or gaming support structure 10 is often oblong in at least one direction. Examples of oblong gaming tables may be oval or elliptical gaming tables such as the gaming support structure 10 generically depicted in FIG. 1. Alternatively, oblong tables having at least two oblong dimensions are embodied in cruciform tables such as that shown in U.S. Pat. No. 5,026,052 as briefly described hereinabove. The oblong support surface 15 of support structure 10 may be properly described as having a centralized basal station or gaming zone as referenced at 14, and separated player stations as referenced at 11 in FIG. 1. Players taking up positions at player stations 11 at opposite ends of the major axis of an oval or elliptical table (as at player stations 17 and 18) may find it difficult to physically access the play-enabling portion of the selected gaming device such as a playing surface 12 of a board game 13. A generic checker board playing surface 12 has been depicted in FIGS. 1 and 4 to illustrate in an exemplary manner the type of playing surface 12 or play-enabling portion that may be displaced from the centralized basal station 14 for enabling game play at distance(s) therefrom.

Games, it will be noted, are typically designed to amuse or entertain the participants or players and thus, game support structures 10 having oblong features in at least one direction may tend to lessen the amusement level of the game for players distantly located from a centralized gaming zone 14, the players often having to lean into the centralized gaming zone to interact with the play-enabling portion of the gaming device. The game support apparatus 20 of the present invention attempts to address the points heretofore raised and provides certain means for bringing the play-enabling portion such as playing surface 12 into closer proximity with players located at separated player stations 11. It is contemplated that the game support apparatus may well function to enhance the gaming experience. Further, it is contemplated that at least two player support structures 60, such as stools, chairs, seats, and the like, may be situated adjacent the separated player stations 16, 17, 18, and 19 for supporting players and thus for enhancing player comfort during game play as further referenced and depicted in FIG. 1.

Notably, the basal station or centralized gaming zone 14 may or may not be centralized relative to certain of the selected player stations 11 chosen by the users. For example, the separated player stations 16 and 17 in FIG. 1 are not opposite basal station 14, but rather orthogonally adjacent basal station 14. Separated player stations 17 and 18 (as well as 16 and 19), however, do represent opposing player stations 11 and thus basal station 11 is centralized relative thereto. Thus, it is contemplated that the separated player stations 11 may oppose one another, and certain plate-extending means or means for extending a game support plate 21 away from the basal station 14 to the player stations 11 may preferably enable bidirectional plate displacement relative to the basal station 14 for facilitating plate-supported game play in an oppositely spaced player setting. Board games, it is noted, are often played between two opposing players, such as in the game of checkers, and thus it is contemplated that the preferred plate-positioning assembly of the present invention enable bidirectional gaming translation.

The article support apparatus or game support apparatus 20 of the present invention is illustrated and referenced in FIGS. 1-5 in various views and preferably comprises game support plate 21 as further illustrated and referenced in FIGS. 1-5; certain plate-positioning means; and certain apparatus-anchoring means. The plate-positioning means may thus be defined certain plate-extending means and certain plate-rotating means. It is contemplated that the plate-extending means may be preferably defined by a track assembly 30 as generally illustrated in FIGS. 1-3, 5, and 6 and as specifically referenced at 30 in FIGS. 5 and 6. It is further contemplated that the plate-rotating means may be preferably defined by a swivel assembly as generally illustrated in FIGS. 1-3, 5, and 6 and as specifically referenced at 40 in FIGS. 2, 5, and 6. It is still further contemplated that the apparatus-anchoring means may be preferably defined by a weighted anchor plate 50 as illustrated and referenced in FIGS. 1-5.

More particularly, the track assembly 30 preferably comprises a plurality of bidirectionally extendable arms 31 received in parallel mounted track or carriage members 32, which carriage members 32 are fixed relative to the movably extendable arms 31. Arms 31 and carriage members 32 are each specifically referenced in FIGS. 2, 3, 5, and 6. An intermediary carriage member or track 33 may interface intermediate the arms 31 and carriage members 32 for enabling further displacement of arms 31 relative to carriage members 32. Tracks 33 are further referenced in FIGS. 2, 5, and 6. Arms 31 are preferably fastened or secured to the inferior surface of support plate 21 as generally depicted in exploded form in FIG. 5, and carriage members 32 are preferably fastened or secured to the superior surface of swivel assembly 40 as further depicted in FIGS. 5 and 6. Further swivel assembly 40 is mounted or fastened to the superior surface of anchor plate 50 as illustrated and depicted in FIG. 5.

Figure 2:
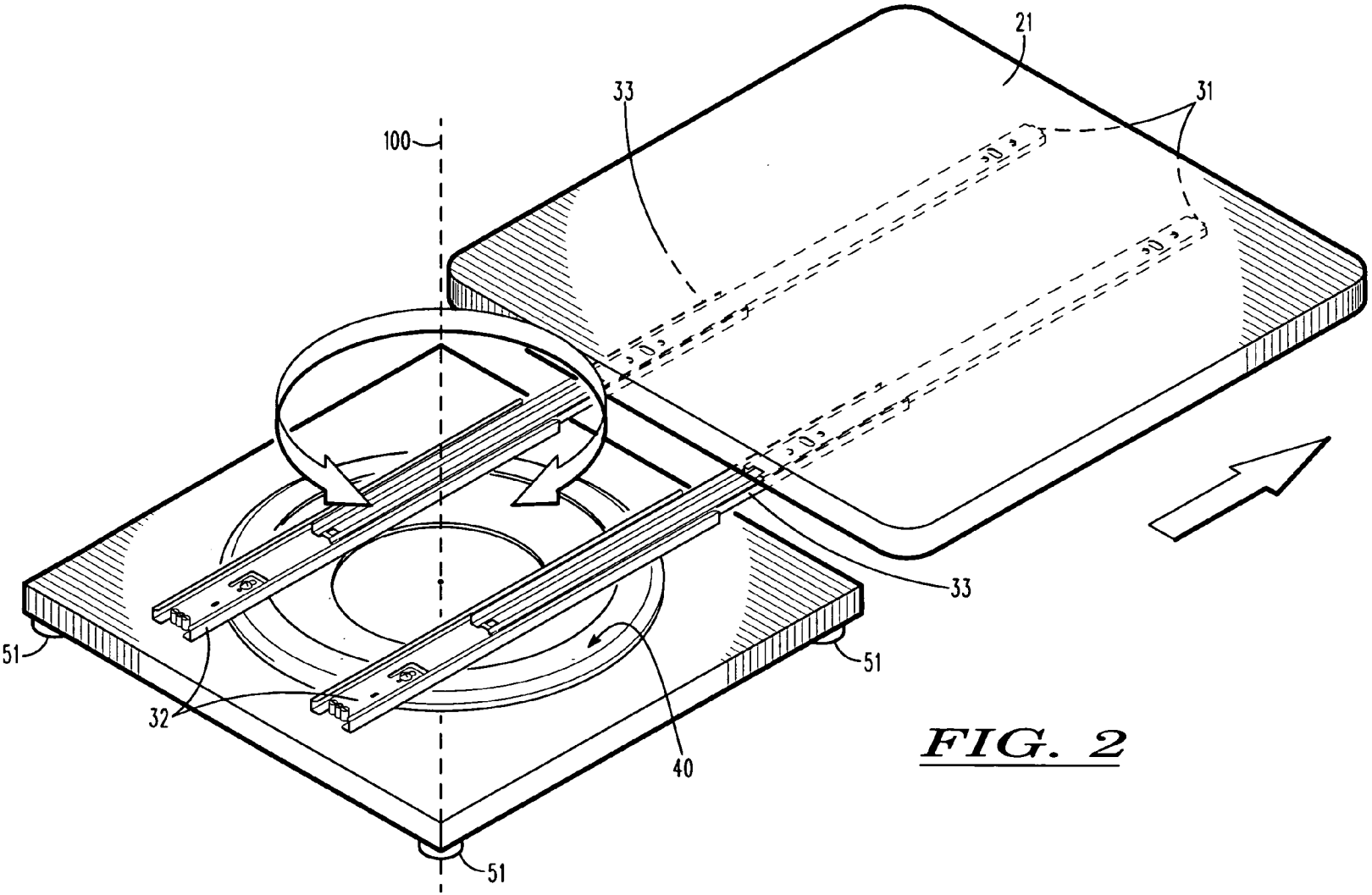
FIG. 2 is a top perspective view of the game support apparatus of the present invention in an extended state and depicting rotational movement about a first pivot axis.
Figure 4:
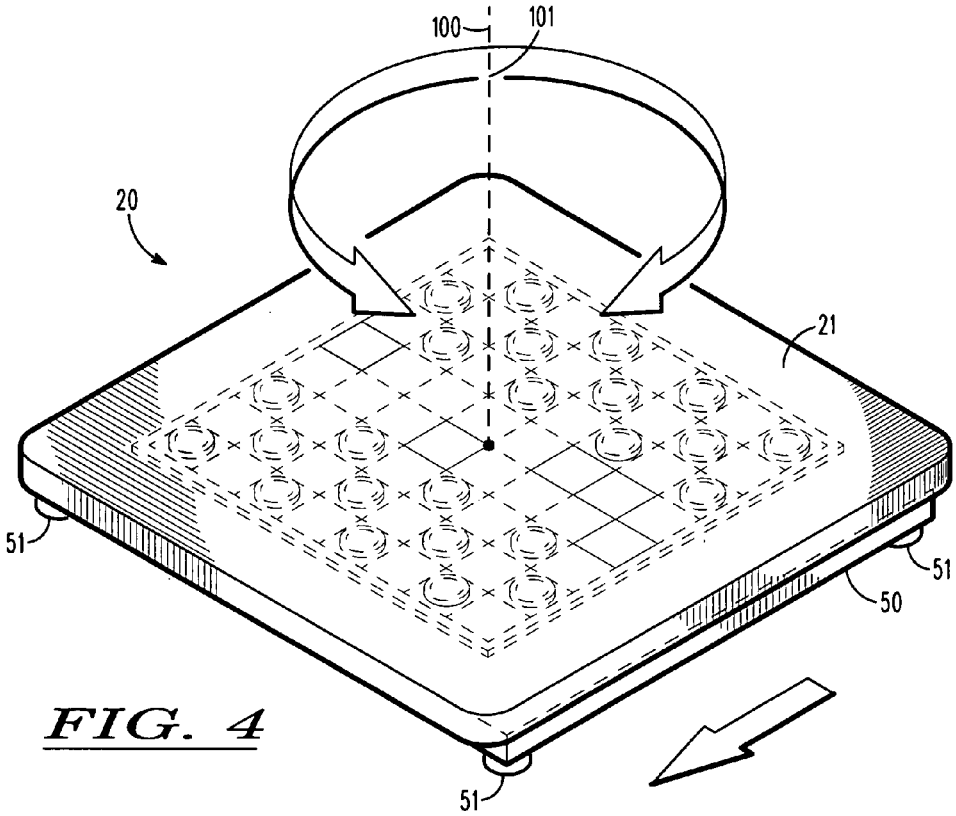
FIG. 4 is a top perspective view of the game support apparatus of the present invention in a retracted state and showing a phantom checker board playing surface in broken lines.
Figure 5:
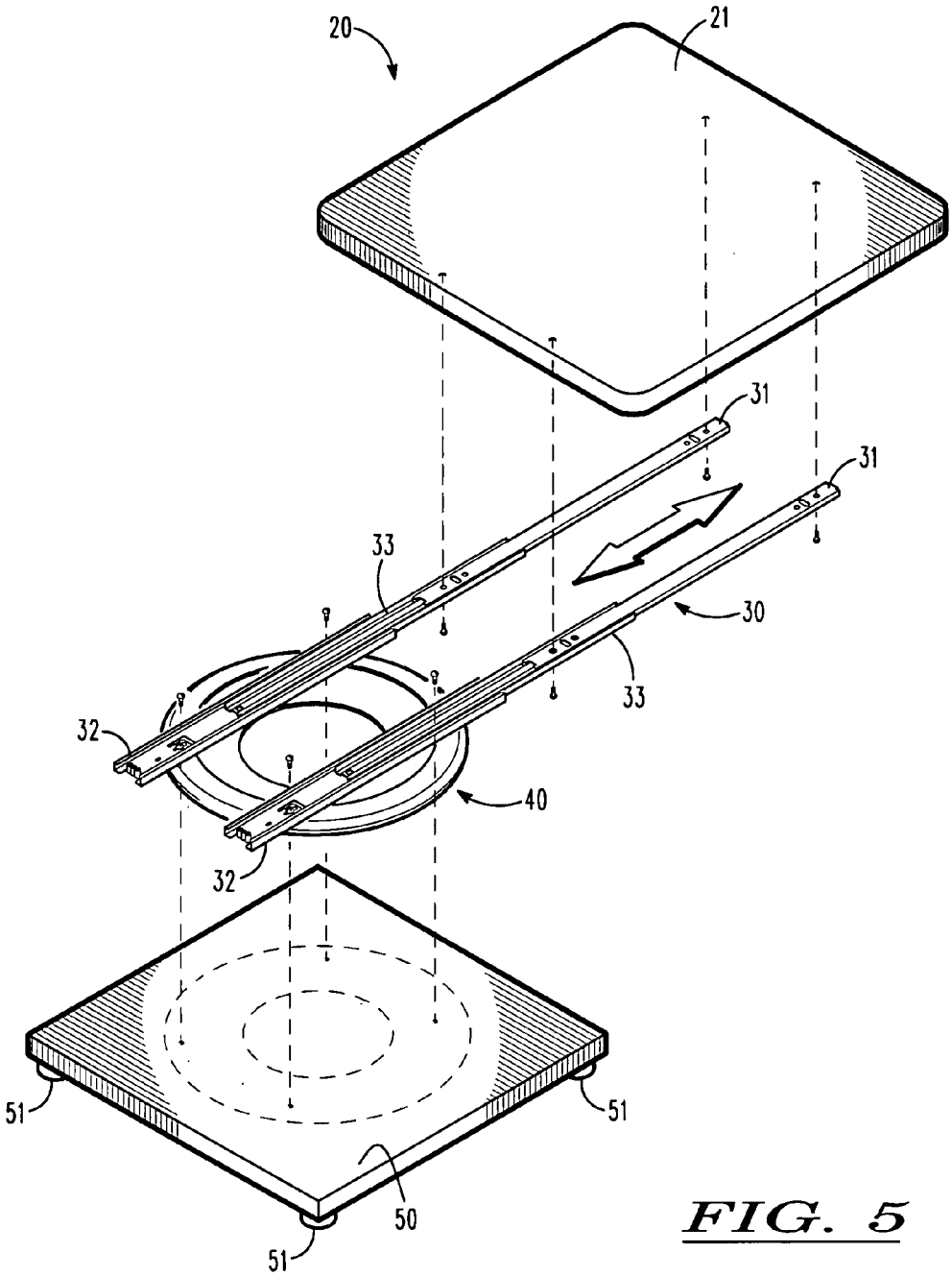
FIG. 5 is an exploded top perspective view of the game support apparatus showing a game support plate, a plate-positioning assembly, and an anchor plate.
Figure 6:
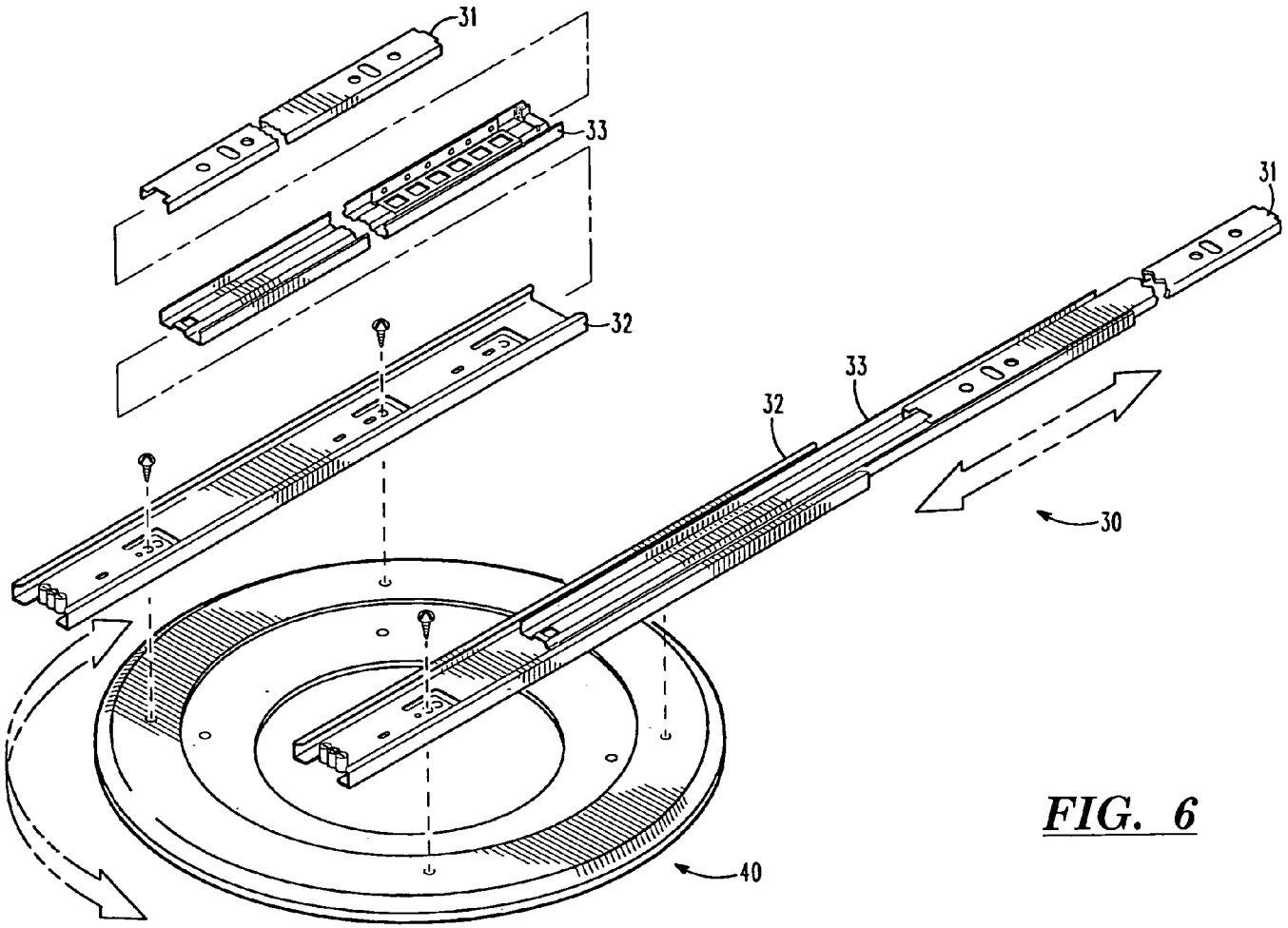
FIG. 6 is an exploded top perspective view of the plate-positioning assembly showing a track assembly and a swivel assembly.

It will thus be seen that game support apparatus 20 preferably comprises certain means for rotating the support plate 21 about an axis of rotation 100 as generally depicted in FIGS. 2 and 4. The game support apparatus 20 thus enables adjacent or opposite users to rotate the play-enabling portion or playing surface 12 by way of the game support plate 21 and further to enable user-aimed or user-aligned game play. In this regard, is will be seen from a comparative inspection of FIGS. 1 and 4 that the checker board playing surface 12 is aimed or aligned as illustrated for players or users positioned at player stations 17 and 18. To re-aim or re-align the checker board playing surface 12 or similar other play-enabling portion of a gaming device so as to align or aim the same at players located at stations such as player stations 16 and 19, one need only rotate the game support plate 21 by way of the plate-rotating means to aim or align the playing surface 12.

As previously introduced, the (apparatus-) anchoring means may be preferably defined by a weighty anchor plate 50. It will be seen from an inspection of the noted figures that the anchor plate 50 and the game support plate 21 may be similarly sized and shaped and further that the plate-positioning means are preferably sandwiched intermediate the anchoring plate 50 and the game support plate 21 for masking the plate-positioning means when game support apparatus 20 is in a retracted state or plate position as comparatively depicted in FIGS. 3 and 4. The anchoring means are further designed to prevent the game support apparatus 20 from tipping when the game support plate 21 is extended away from the basal station 14 to a select player station 11.

In this last regard, it will be understood that when the game support plate 21 is extended to a select player station 11, certain downwardly acting forces (the weight of game support plate) will tend to pull the game support plate 21 toward support surface 15, thereby creating torque forces (extending toward player station 16 in FIG. 1) that will tend to rotate anchor plate 50 about an axis orthogonal to axis of rotation 100. In this regard, it is contemplated that anchor plate 50 should be sufficiently massive so as to prevent tipping motion of the game support apparatus 20 when the game support plate 21 is in an extended position as generally depicted in FIG. 1.

Notably, the anchor plate 50 may further comprise certain apparatus-to-surface interfacing means extending intermediate the anchor plate 50 and the support surface 15 for preventing damage either to the anchor plate 50 or the support surface 15 from frictional engagement therebetween during game play. In this last regard, it is contemplated that the interfacing means may be preferably defined by a plurality of anchor legs outfitted with anchor shoes 51, which anchor shoes 51 may be preferably located in inferior adjacency the periphery or corners of the anchor plate 50 as generally depicted in FIGS. 2-5. It is contemplated that anchor shoes 51 may be positioned in inferior adjacency to the corners or outer periphery of anchor plate 50 for maximizing stability of the game support apparatus 20 during game play. In this regard, it is contemplated that at least three legs or shoes 51 may be utilized to maximize stability through a tripod type construction, though the same has not been specifically illustrated. In this regard, the game support apparatus could be positioned upon a floor-based or ground-based support surface 15(*a*) as referenced in FIG. 1.

It will thus be seen that the present invention contemplates a game support apparatus 20 for enabling game play in a spaced player setting. The game support apparatus 20 essentially comprises a game support plate 21, certain plate-extending means, and a basal interface as may be achieved via the anchoring means. The plate-extending means function to extend the game support plate 21 away from the basal interface, which interface functions to interface the game support apparatus 20 with a gaming support surface such as support surface 15. The gaming support surface inherently has physically separated player stations 11.

The game support plate 21 functions to support a gaming device such as a common board game. The selected gaming device is supportable atop the game support plate 21 and has a play-enabling portion such as playing surface 12. The game support plate 21 is thus selectively extendable to the separated player stations 11 and the play-enabling portion of the gaming device enables game play. Thus, the game support apparatus 20 functions to enable game play in a spaced player setting.

While the above description contains much specificity, this specificity should not be construed as limiting the scope of the invention, but rather as an exemplification of the invention. For example, as is described hereinabove, it is contemplated that arms 31 are preferably fastened or secured to the inferior surface of support plate 21 as generally depicted in exploded form in FIG. 5, and that carriage members 32 are preferably fastened or secured to the superior surface of swivel assembly 40 as further depicted in FIGS. 5 and 6. Further, it has been specified that swivel assembly 40 is preferably mounted or fastened to the superior surface of anchor plate 50 as illustrated and depicted in FIG. 5.

Figure 3:
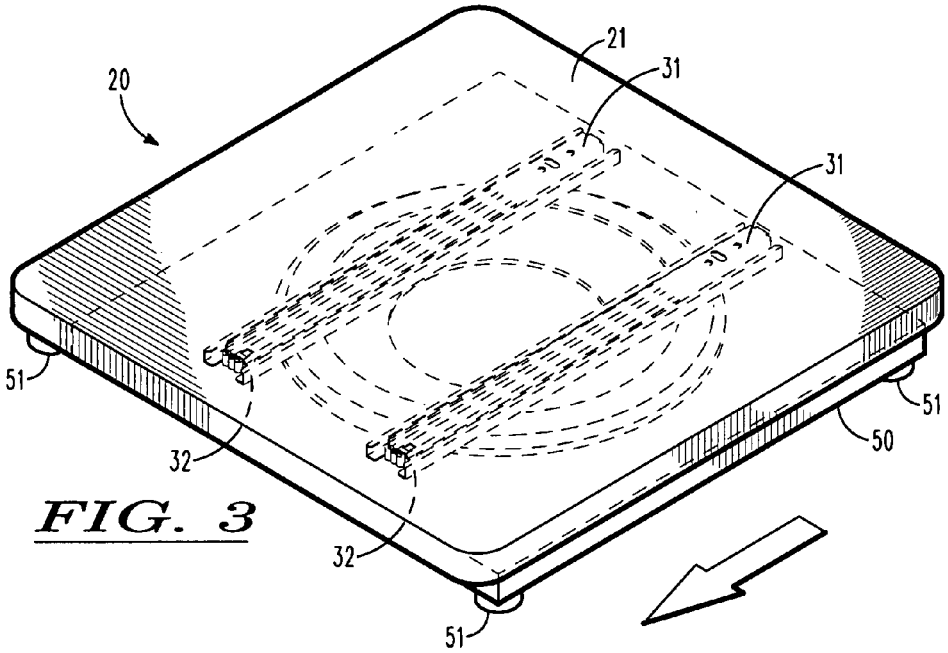
FIG. 3 is a top perspective view of the game support apparatus of the present invention in a retracted state and showing a hidden plate-positioning assembly in broken lines.

It is conceivable, however, that carriage members 32 could be mounted to the superior surface of anchor plate 50; the arms 31 could be mounted to the swivel assembly 40; and the swivel assembly 40 could be mounted to the inferior surface of the game support plate 21. Even though this arrangement has not been specifically illustrated, it is believed within the ordinary skill of those skilled in the art to practice the invention as here briefly specified without undue experimentation. This arrangement would necessarily enable rotation at the spaced player stations 11 or at the basal station or centralized zone 14, depending on whether the track assembly 30 was in an extended state as depicted in FIGS. 1 and 2 or a retracted state as generally depicted in FIGS. 3 and 4.

It is further conceivable that two swivel assemblies 40 could be incorporated into the design to enable rotational movement at anchor plate 50 and to enable rotational movement at the game support plate 21. This structural arrangement would allow users to simultaneously rotate the extended state configuration about the axis of rotation 100 extending through the anchor plate 50 and also rotate the game support plate 21 about an axis of rotation 101 extending through the game support plate 21. This arrangement would enable the center of the game support plate 21 to trace a circular path, while maintaining a selected user-aligned position of the game support plate 21. In other words, if a black checker player arrangement was aimed at player station 17 in FIG. 1, and the game support plate 21 was rotated about the axis of rotation 100, the game support plate 21 could be rotated about the axis of rotation 101 to maintain the black checker arrangement oriented toward player station 17 as the center of the game support plate 21 traces a circular path.

It may be further understood that the present invention contemplates a certain gaming system for facilitating game play in a spaced player setting, the gaming system comprising a gaming support structure 10; a gaming device such as a board game 13 or similar other interactive device having a play-enabling portion; a game support apparatus 20; and certain player support structures 60. The gaming support structure 10 preferably comprising a support surface 15, which support surface 15 may be oblong in at least one direction and may preferably comprise a basal station 14 and separated player stations 11. The gaming device inherently comprises a play-enabling portion such as playing surface 12, and the game support apparatus 20 preferably comprises a game support plate 21 and certain means for extending the game support plate 21 away from the basal station 14 to the separated player stations 11. The playing surface 12 or play-enabling portion enables game play, and the game support apparatus 20 enables game play (by way of the play-enabling portion) in a spaced player setting.

Still further, the present invention may be said to disclose certain gaming methodology. In this regard, it is believed that a gaming method for facilitating game play in a spaced player setting may preferably comprise the steps of centralizing a game-positioning assembly (such as the cooperative assemblage of game support apparatus 20 and a gaming device such as board game 13) relative to separated player stations (such as player stations 11); extending the game-positioning assembly to a select (initial) player station for enabling extended (assembly) game play; and retracting the game-positioning assembly from the select player station for enabling retracted (assembly) game pause.

In other words, participants may initiate game play by first placing the game-positioning assembly atop a support surface as would typically be the case when un-boxing a board game or the like at a kitchen table. Then, via certain means, the play-enabling portion of a centrally-positioned gaming device would be extended to a player station spatially separated from the centralized game-positioning assembly. It is contemplated that the process of extending a gaming device to spatially separated player stations from a centralized position effects a unique gaming experience. When game play is to be paused, for whatever reason, it is contemplated that the methodology allows for retraction of the game-positioning assembly to the centralized zone. Retracted game pause may thus occur between turns or when storing the game-positioning assembly or when rotating the game-positioning assembly for enabling certain pre-extension, player-aligned game play. In keeping with the notion of alternative plate-rotating means, it is further contemplated that the game-positioning assembly may be rotated after extending the game-positioning assembly to the select player station for enabling post-extension, player-aligned game play.

After retracting the game-positioning assembly from the select player station, it is contemplated that the game-positioning assembly may be extended to at least one secondary player station for enabling game play at multiple (separated) player stations. Notably, the game-positioning assembly need not be retracted before extending the same to a secondary player station and thus it is further contemplated that the game-positioning assembly may be extended to a secondary player station after extending the game-positioning assembly to the select player station for further enabling game play at the separated player stations.

It is further contemplated that the article support apparatus or game support apparatus 20 may further function to enable more generic article interaction at an oblong table or similar other support surface. In other words, in addition to games, it is contemplated that the article support apparatus 20 may enable eased interaction with common activities performed at support surfaces such as (oblong) kitchen tables and the like. In this regard, it is contemplated that certain hobby, craft, eating, and work activities may be generally performed at a support surface. More particularly, the user may utilize article support apparatus 20 to interact with model-making, jewelry-making, taco-construction, fondue-tasting, laptop-input and laptop display activities by repositioning the article placed upon the article support apparatus and translating the same to spaced participants located at the periphery of the support surface 15.

Accordingly, although the invention has been described by reference to certain preferred embodiments and certain methodology, it is not intended that the novel disclosures herein presented be limited thereby, but that modifications thereof are intended to be included as falling within the broad scope and spirit of the foregoing disclosure, the following claims and the appended drawings.

I claim:

1. A gaming system for facilitating game play in a spaced player setting, the gaming system comprising, in combination:

a gaming support structure, the gaming support structure comprising a support surface, the support surface being oblong in at least one direction, the oblong support surface having a basal station and separated player stations;

a gaming device, the gaming device having a play-enabling portion; and a game support apparatus received at the basal station, the game support apparatus comprising a game support plate and means for extending the game support plate away from the basal station to the separated player stations, the game support plate engaging the gaming device, the play-enabling portion enabling game play, the game support apparatus for enabling game play in a spaced player setting.

2. The gaming system of claim 1 wherein the basal station is centralized and the separated player stations oppose one another, the means for extending the game support plate away from the basal station to the separated player stations enabling bidirectional plate displacement relative to the basal station, the gaming system thus facilitating game play in an oppositely spaced player setting.

3. The gaming system of claim 1 comprising at least two player support structures, the player support structures being situated adjacent the separated player stations for supporting players and for enhancing player comfort during game board play.

4. The gaming system of claim 1 wherein the game support apparatus comprises means for rotating the game support plate about an axis of rotation, the game apparatus enabling a user to selectively rotate the play-enabling portion, the game support apparatus thus enabling user-aimed game play.

5. The gaming system of claim 1 wherein the game support apparatus comprises anchoring means, the means for extending the game support plate extending intermediate the anchoring means and the game support plate, the anchoring means for preventing the game support apparatus from tipping when the game support plate is in an extended plate position.

6. The gaming system of claim 5 wherein the anchoring means is defined by an anchor plate, the anchor plate and the game support plate being similarly sized and shaped, the anchor plate and the game support plate for masking the means for extending the game support plate when the game support plate is in a retracted plate position.

7. The gaming system of claim 6 wherein the anchor plate comprises interfacing means, the interfacing means extending intermediate the anchor plate and the support surface, the interfacing means for preventing damage to the anchor plate and the support surface during game play.

8. The gaming system of claim 7 wherein the anchor plate comprises at least three anchor corners and the interfacing means are defined by anchor shoes, the anchor shoes being located adjacent the anchor corners for maximizing game support apparatus stability during game play.

9. An article support apparatus for enabling article-user interaction in a spaced user setting, the article support apparatus comprising article-supporting means, support-positioning means, and a basal interface, the support-positioning means for extending the article-supporting means away from the basal interface, the basal interface for interfacing with an article support surface, the article support surface having separated user stations, the article-supporting means for supporting an interactive article, the interactive article being supportable by the article-supporting means and having a user-interactive portion, the article-supporting means selectively positionable adjacent the separated user stations via the support-positioning means, the user-interactive portion enabling user interaction, the article support apparatus for enabling article-user interaction in a spaced user setting.

10. The article support apparatus of claim 9 wherein the article support surface is oblong in at least one direction, the basal interface for interfacing with the article support surface at a centralized portion thereof intermediate the separated user stations.

11. The article support apparatus of claim 10 wherein the separated user stations oppose one another, the support-positioning means enabling bidirectional support displacement relative to the basal interface, the article support apparatus thus enabling article-user interaction in an oppositely spaced user setting.

12. The article support apparatus of claim 9 comprising support-rotating means, the support-rotating means for rotating the article-supporting means about an axis of rotation, the support-rotating means enabling a user to rotate the article-user interactive portion about the axis of rotation, the article support apparatus thus enabling user-aimed article-user interaction.

13. The article support apparatus of claim 9 wherein the basal interface comprises anchoring means, the support-positioning means extending intermediate the basal interface and the article-supporting means, the anchoring means for preventing the article support apparatus from tipping when the article-supporting means is in an extended support position.

14. The article support apparatus of claim 10 wherein the anchoring means and the article-supporting means enable viewing of the support-positioning means when the article-supporting means is in a retracted support position.

15. A gaming method, the gaming method for facilitating game play in a spaced player setting, the gaming method comprising the steps of:

centralizing a game-positioning assembly relative to separated player stations;

extending the game-positioning assembly to a select player station for enabling assembly-extended game play; and retracting the game-positioning assembly from the select player station for enabling assembly-retracted game pause.

16. The gaming method of claim 15 wherein game play is selectively paused after retracting the game-positioning assembly from the select player station.

17. The gaming method of claim 15 wherein the game-positioning assembly is rotated after retracting the game-positioning assembly from the select player station for enabling pre-extension player-aligned game play.

18. The gaming method of claim 15 wherein the game-positioning assembly is rotated after extending the game-positioning assembly to the select player station for enabling post-extension player-aligned game play.

19. The gaming method of claim 15 wherein the game-positioning assembly is extended to a secondary player station after retracting the game-positioning assembly from the select player station for enabling game play at the separated player stations.

20. The gaming method of claim 15 wherein the game-positioning assembly is extended to a secondary player station after extending the game-positioning assembly to the select player station for enabling game play at the separated player stations.

* * * * *